US008875912B2

(12) United States Patent
Haberl et al.

(10) Patent No.: US 8,875,912 B2
(45) Date of Patent: Nov. 4, 2014

(54) VEHICLE CRANE

(71) Applicant: Palfinger AG, Salzburg (AT)

(72) Inventors: Walter Haberl, Nussdorf (AT); Erich Wimmer, Eggelsberg (AT)

(73) Assignee: Palfinger AG, Salzburg (AT)

( * ) Notice: Subject to any disclaimer, the term of this patent is extended or adjusted under 35 U.S.C. 154(b) by 0 days.

(21) Appl. No.: 13/713,372

(22) Filed: Dec. 13, 2012

(65) Prior Publication Data

US 2013/0092648 A1 Apr. 18, 2013

Related U.S. Application Data

(63) Continuation of application No. PCT/AT2011/000266, filed on Jun. 16, 2011.

(30) Foreign Application Priority Data

Jun. 17, 2010 (AT) ..... GM379/2010

(51) Int. Cl.

| | |
|---|---|
| ***B66C 23/42*** | (2006.01) |
| ***B66C 23/36*** | (2006.01) |
| ***B66C 13/10*** | (2006.01) |
| ***B66C 23/70*** | (2006.01) |
| ***B66C 13/18*** | (2006.01) |

(52) U.S. Cl.

CPC ..... *B66C 13/18* (2013.01); *B66C 23/36* (2013.01); *B66C 13/10* (2013.01); *B66C 23/42* (2013.01); *B66C 23/705* (2013.01)

USPC ..... 212/300; 212/299; 212/256; 212/349

(58) Field of Classification Search

USPC ..... 212/299, 300, 201, 256, 349

See application file for complete search history.

(56) References Cited

U.S. PATENT DOCUMENTS

| | | | | |
|---|---|---|---|---|
| 4,953,720 | A * | 9/1990 | Okano et al. | 212/176 |
| 4,969,789 | A | 11/1990 | Searle | |
| 6,186,347 | B1 * | 2/2001 | Reifenscheid et al. | 212/300 |
| 8,201,349 | B2 | 6/2012 | Kanzler et al. | |
| 2004/0173784 | A1 | 9/2004 | Kanzler | |

(Continued)

FOREIGN PATENT DOCUMENTS

| | | |
|---|---|---|
| CA | 2 389 775 | 1/2004 |
| DE | 101 53 105 | 8/2002 |

(Continued)

OTHER PUBLICATIONS

International Search Report issued Nov. 11, 2011 in International (PCT) Application No. PCT/AT2011/000266.

(Continued)

*Primary Examiner* — Emmanuel M Marcelo

(74) *Attorney, Agent, or Firm* — Wenderoth, Lind & Ponack, L.L.P.

(57) ABSTRACT

A vehicle crane—in particular an articulated-arm crane—includes a lifting arm and one or more articulated arms, and the geometry of the crane arms can be changed with respect to one another. A load cable can be guided or is guided on the crane arms. A compensation device allows the tension in the load cable to be controlled or regulated upon a change in the geometry of the crane arms with respect to one another.

16 Claims, 4 Drawing Sheets

(56) References Cited

U.S. PATENT DOCUMENTS

| | | | | |
|---|---|---|---|---|
| 2006/0065616 | A1* | 3/2006 | Diehl | 212/300 |
| 2010/0078403 | A1* | 4/2010 | Wimmer | 212/299 |
| 2010/0236107 | A1 | 9/2010 | Kanzler et al. | |
| 2011/0253661 | A1* | 10/2011 | Smith et al. | 212/255 |

FOREIGN PATENT DOCUMENTS

| | | |
|---|---|---|
| EP | 1 431 236 | 6/2004 |
| EP | 1 491 485 | 12/2004 |
| EP | 1 528 263 | 5/2005 |
| FR | 1 548 863 | 12/1968 |
| SE | 431 438 | 2/1984 |
| WO | 2007/000216 | 1/2007 |

OTHER PUBLICATIONS

Austrian Patent Office Search Report completed Feb. 9, 2011 in Austrian Patent Application No. GM 379/2010.

* cited by examiner

VEHICLE CRANE

The invention relates to a vehicle crane—in particular an articulated arm crane—with a lifting arm and one or more articulated arms, which can be varied with respect to one another in relation to their geometry, and a load cable, which can be guided or is guided on the crane arms.

Furthermore, the invention relates to a method for keeping a tension of a load part of a vehicle crane constant.

Vehicle cranes are already known from the prior art in large numbers.

The object of the invention is to disclose a vehicle crane that is improved compared to the prior art.

This object is achieved in the vehicle crane having the features according to a first aspect of the invention.

By means of the cable deflections on the crane arms, length changes of the cable are produced when unfolding and folding up the crane; an over-stressing of the cable or the forming of a slack cable when unfolding or folding up the crane arms can be prevented by the compensation device.

Furthermore, during the crane operation, the compensation device can also guide a substantially load-free cable synchronously with respect to the crane arms pivoting with respect to one another. This can be achieved in that the compensation device brings about a substantially lasting and constant tension of the load cable.

Further advantageous configurations of the invention are defined in the dependent claims.

According to a preferred embodiment, it may be provided that the compensation device, upon a change in the geometry of the crane arms, regulates the tension of the load cable to a substantially lasting and constant value. Therefore, a uniform tension of the load cable can be achieved upon any change in the geometry of the crane arms.

It has proven to be particularly advantageous if the compensation device is hydraulic. As many vehicle cranes already have a hydraulic cable winch, the compensation device can therefore be adopted into the existing hydraulic system.

According to a preferred embodiment, it may be provided that the compensation device has at least one pressure limiting valve.

It may furthermore be provided that the compensation device has at least one directional valve—preferably a 2/2-way valve.

It has proven to be particularly advantageous if the at least one directional valve is electrically switchable. The switching off and on of the directional valve can thus be achieved in a simple manner.

It may particularly preferably be provided that the vehicle crane has a cable winch, the compensation device being formed at least partly on the cable winch. A compact construction can thus be achieved.

It has proven to be particularly advantageous here if the compensation device cooperates with the cable winch.

According to a preferred embodiment, it may be provided that the cable winch has a drive, the compensation device cooperating with the drive of the cable winch. Together with the drive of the cable winch, already existing hydraulic configurations of the cable winch can be used and influenced by the compensation device.

According to a further preferred embodiment, it may be provided that the compensation device has a distance sensor, the distance sensor being releasably fastenable on the cable end of the load cable.

It has proven to be particularly advantageous here if the distance sensor has at least one spring element—preferably a gas spring. Spring elements are a particularly economical variant to make length changes compensatable.

Protection is also sought here for a method for keeping a tension of a load cable of a vehicle crane constant, in particular an articulated arm crane, the load cable being guided on a lifting arm and one or more articulated arms, which can be varied with respect to one another in relation to their geometry, wherein

- in one step, the load cable is tensioned by means of a cable winch by a compensation device,
- in a further step—upon a change in the geometry of the crane arms with respect to one another, which causes a shortening of the guidance of the load cable on the crane arms—the load cable is wound onto the cable winch by the compensation device,
- in a further step—upon a further change in the geometry of the crane arms with respect to one another, which causes a lengthening of the guidance of the load cable on the crane arms—the load cable is unwound from the cable winch by the compensation device.

BRIEF DESCRIPTION OF THE DRAWINGS

Further details and advantages of the present invention are described in more detail below with the aid of the figure description with reference to the embodiments shown in the drawings, in which.

DETAILED DESCRIPTION OF THE INVENTION

Figure 1:
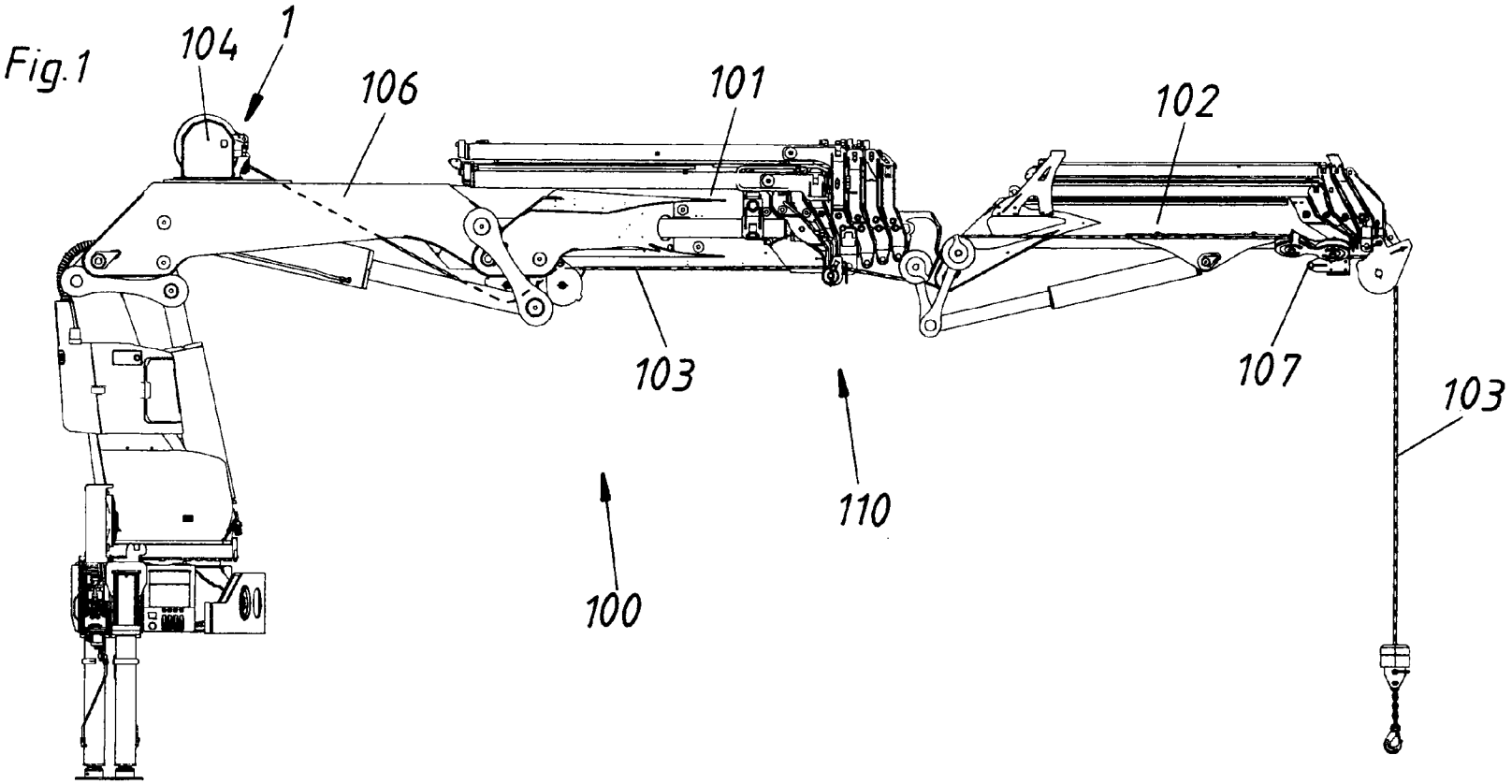
FIG. 1 shows a side view of an articulated arm crane with a compensation device.

FIG. 1 shows the crane arm system 110 of a vehicle crane 100 with a lifting arm 106 and, arranged thereon in an articulated manner, a first articulated arm 101 and on this first articulated arm 101—which is telescopic—a second articulated arm 102 arranged in an articulated manner.

The vehicle crane 100, in this case, has a cable winch 104. This cable winch 104 is used to lift loads by means of the load cable 103.

Using the lateral cable guide, the cable 103, when folding up the crane arm system 110 of the vehicle crane 100, can remain reeved. The load cable 103, during folding up, is fastened to the second articulated arm 102, normally to a fixing point 107. As the load cable 103 runs from the lifting arm 106 by way of the first articulated arm 101 and further from the crane thrust arms of the first articulated arm 101 to the second articulated arm 102 by way of a plurality of rotational points, a shortening or lengthening of the cable 103 is produced when folding in the joints and when displacing the crane thrust arms.

In the prior art, this length change, without correction by the crane driver, on the one hand produces slack cable, on the other hand, the cable tensile force increases until the overload prevention device of the winch switches off the crane functions after reaching the maximum permissible cable tensile force. This leads to unnecessarily high loadings of the components and, furthermore, the crane driver is possibly overburdened by the many functions to be actuated.

A low cable tensile force is applied to the reeved load cable 103 suspended on the cable fixing point 107 owing to the compensation device 1 during the folding up or unfolding of the crane 100. The cable 103 is tensioned by the cable winch 104: if less cable length is needed between the cable winch 104 and cable fixing point 107, this cable 103 is wound on, if more cable length is needed, this load cable 103 is drawn from the cable winch 104.

The crane arm system 110, shown in this embodiment, of the articulated arm crane 100 can, on the one hand, pivot the two articulated arms 101 and 102 with respect to one another in such a way that, in at least one of their two end positions, the two articulated arms 101 and 102 are located substantially parallel to one another. Likewise, the two crane arms 106 and 101 can be pivoted with respect to one another in such a way that, in at least one of their two end positions, the two crane arms 106 and 101 also lie substantially parallel to one another.

This articulated arm crane 100 in this case has a compensation device 1 for tensioning a load cable 103, the compensation device 1 cooperating with the cable winch 104 of the articulated arm crane 100—to be precise with the drive 105 (not shown, see FIG. 2) of the cable winch 104. As can be seen from this FIG. 1, the compensation device 1 is formed here on the cable winch 104 of the vehicle crane 100.

Figure 2:
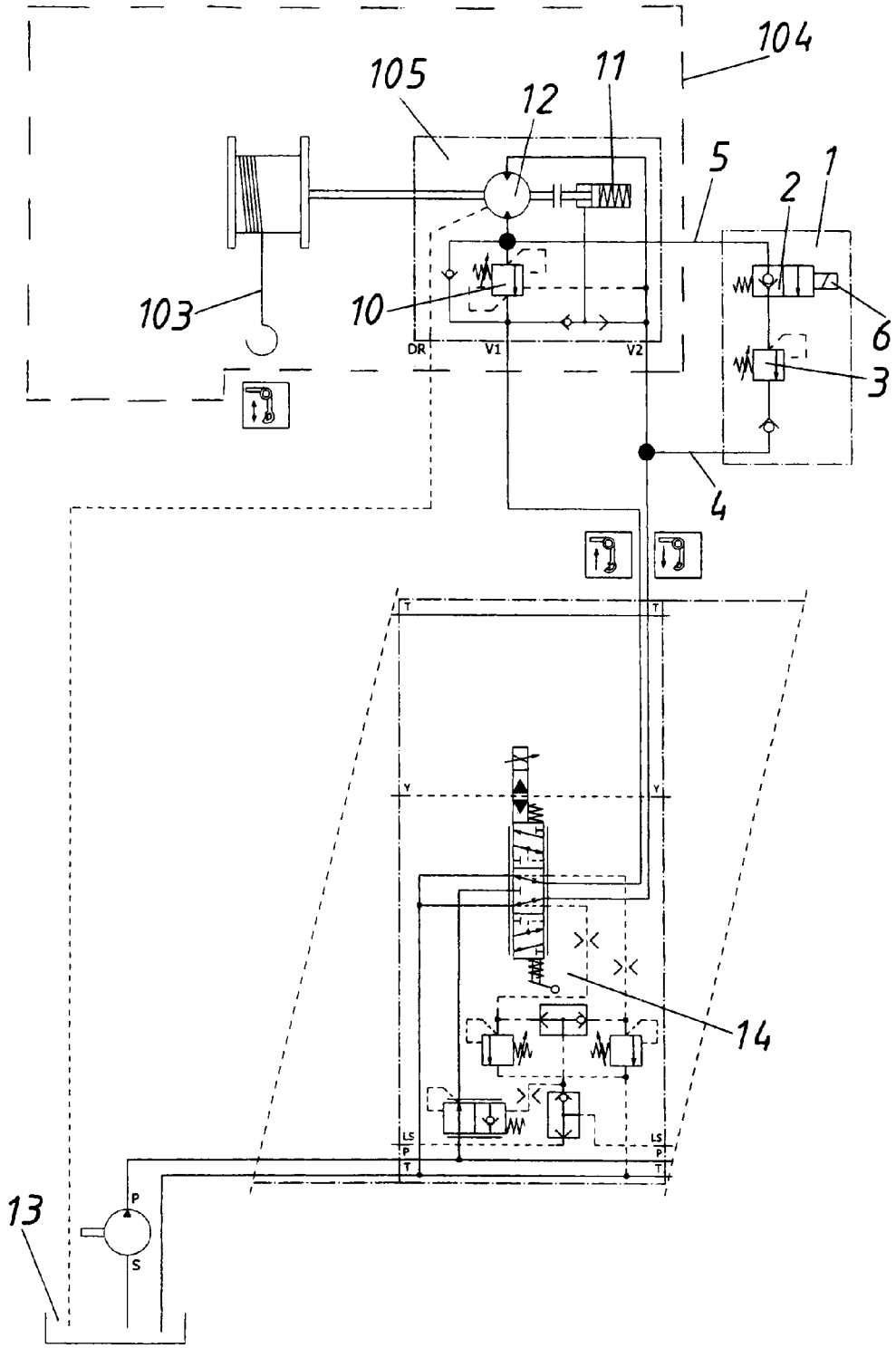
FIG. 2 shows a schematic circuit diagram.

FIG. 2 shows a schematic circuit diagram of the cable winch 104, including the supply with a load cable 103 arranged thereon. The cable winch 104 in this case has a drive 105. The compensation device 1 is arranged on this drive 105. The drive 105 is controlled by means of the main control valve 14 of the crane to lift and lower the load cable 103 of the cable winch 104. The fluid container 13 in this case supplies the necessary fluid—preferably oil—for the hydraulic drive 105.

A connection by way of the two connection lines 4 and 5 to the supply connections of the cable winch motor 12 is produced by means of a 2/2-way valve 2 of the compensation device 1 and a pressure limitation valve 3 of the compensation device 1.

To activate the function, the 2/2-way valve 2—the 2/2-way valve 2 is electrically switchable 6 here—is opened and the function "lift cable winch" is activated on the main control valve 14. The pressure thus being produced opens the brake 11 and the oil flow allows the cable winch 104 to draw in the cable 103 and tension it. Once the cable 103 is tensioned, the winch 104 stops and the oil flow flows back by way of the pressure limitation valve 3. The pressure adjusted at the pressure limitation valve 3 produces the level of the cable tensile force.

If a reduction in the necessary free cable length is now adjusted during the crane movement, the cable 103 is wound on further as described above. In this case, the maximum cable speed is produced from the oil flow adjusted at the main control valve 14.

If a lengthening of the free cable end is necessary, the winch 104 is rotated by the cable tensile force in the reverse direction and the cable 103 is unwound. The volume flow being produced by the drive 105 rotating in the lowering direction also flows by way of the 2/2-way valve 2 and the pressure limitation valve 3. Because of the pressure constantly applied by the function "lift cable winch" activated at the main control valve 14, the brake 11 remains constantly open and allows the cable tensile force to be regulated. The load holding valve 10 is circumvented by the compensation device 1 here.

The tension of the load cable 103 of a vehicle crane 100, not shown, (see FIG. 1) is thus kept constant, the load cable 103 being guided on the lifting arm 106 and the articulated arms 101 and 102 (see FIG. 1), the load cable 103 being tensioned in one step by the compensation device 100 by means of the cable winch 104 and, in a further step—upon a change in the geometry of the crane arms 106, 101 and 102 with respect to one another—which causes a shortening of the guide load of its load cable 103 on the crane arms 106, 101, 102—the load cable 103 is wound onto the cable winch 104 by the compensation device 1 and, on the other hand, in a further step—upon a further change in the geometry of the crane arms 106, 101, 102 with respect to one another—which causes a lengthening of the guidance of the load cable 103 at the crane arms 106, 101, 102—the load cable 103 is unwound from the cable winch 104 by the compensation device 1. As a result, a constant tensioning of the load cable 103 is brought about by the compensation device 1 for all operating states of the crane arms 106, 101, 102 of the vehicle crane 100.

Figure 3:
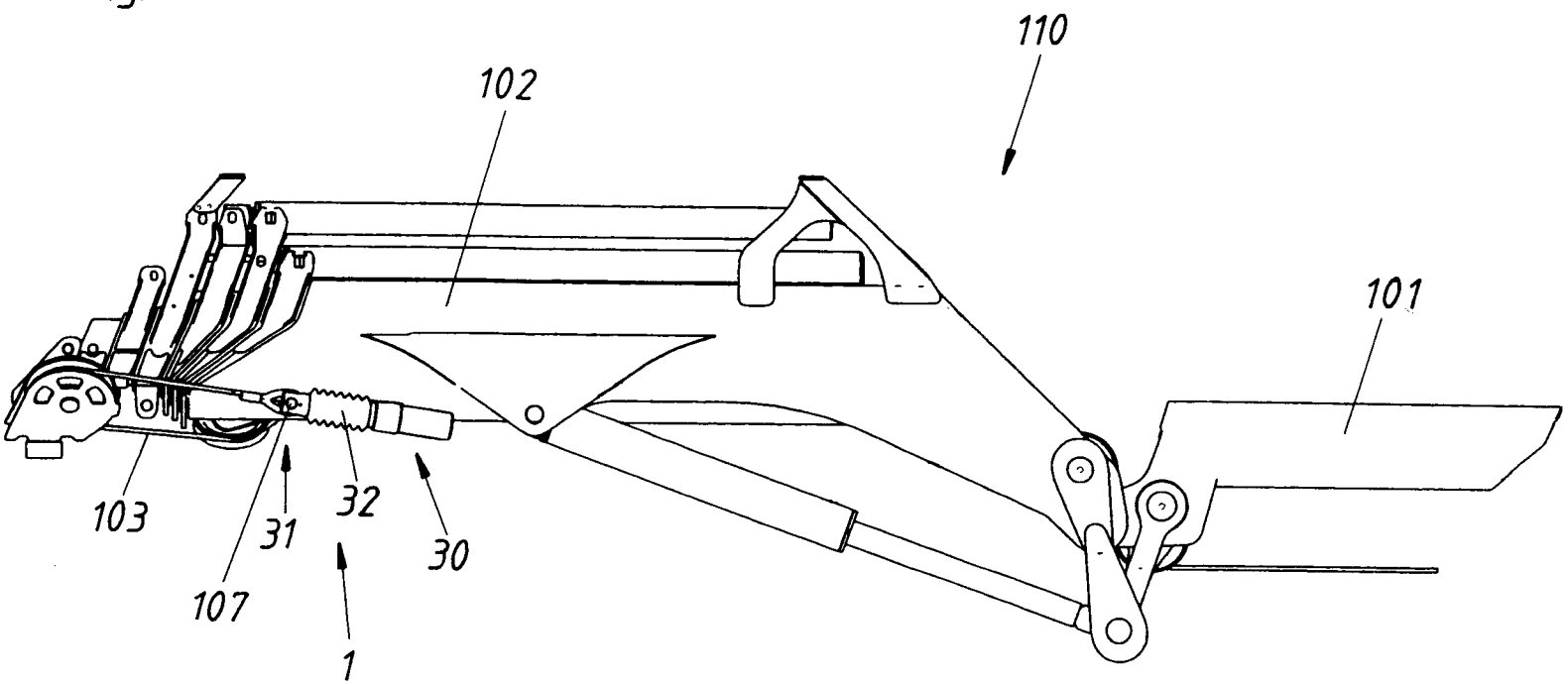
FIG. 3 shows a variant of a compensation device in a vehicle crane in a side view.

FIG. 3 shows a variant of a compensation device 1 on a part of the crane arm system 110 in a side view. The crane arm system 110, in this case, has the two crane arms 101 and 102 and a further crane arm 106 is not shown here.

In this embodiment, the compensation device 1 acts by means of the cable fixed point 107 of the cable 103. The winch 104 (not shown) is controlled by means of the distance sensor 30 at the cable fixed point 107. This distance sensor 30 consists of a spring element 32—preferably a gas spring—which is retracted in the unactuated state. This adjustment is monitored by means of a switch (not shown). It is not possible to activate the compensation device 1 in this position, as this is the normal cable winch operation.

Before activation of the compensation device 1, the cable end 31 is fastened on the distance sensor 30 and the spring element 32 is prestressed to approximately half its lift by winding on the cable 103 using the winch 104.

It is now possible to activate the compensation device 1, the release of which takes place by means of the monitoring switch, not shown. The position of the spring element 32, to be precise its lift, is measured with an analogue sensor (not shown) and passed as an electric signal to the control (not shown) of the winch 104. The winch 104 is activated by this control and the cable 103 is either wound on or unwound until the distance sensor 30 reaches the centre position.

Upon a change in the geometry of the crane arms 101, 102 and 106 with respect to one another, the necessary adaptation of the cable length is carried out by the control, in that the cable 103 is wound on or unwound from the winch 104 until the spring element 32 again reaches the centre position.

As a result, an overloading of the cable 103 or the forming of a slack cable is prevented.

Figure 4:
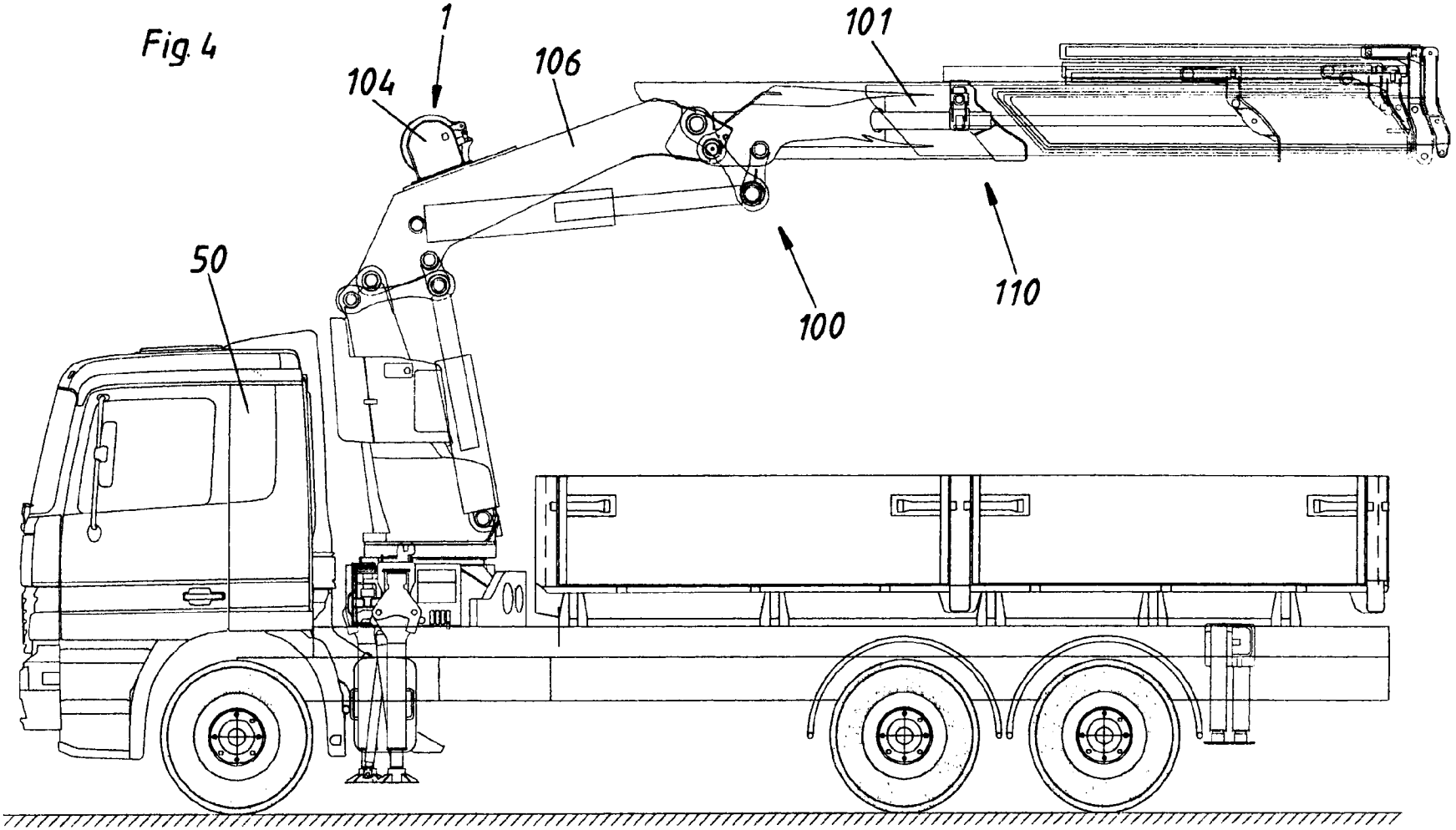
FIG. 4 shows a vehicle with a vehicle crane with a compensation device in a side view.

FIG. 4 shows a side view of a vehicle 50, on which a vehicle crane 100 is arranged. The crane arm system 110 of the vehicle crane 100 in this case has the lifting arm 106 and an articulated arm 101. The cable winch 104, which has the compensation device 1, is arranged on the lifting arm 106 in this preferred embodiment.

Even if the invention was specifically described with the aid of the embodiment shown, it is obvious that the application subject is not limited to this embodiment.

The invention claimed is:

1. A device comprising:

a vehicle crane with a lifting arm and an articulate arm, which can be varied with respect to one another in relation to their geometry;

a load cable guided on the lifting and articulate arms; and a compensation device which controls the tension in the load cable based upon a change in the geometry of the lifting and articulate arms with respect to one another.

2. The device according to claim 1, wherein the compensation device controls the tension of the load cable to a substantially lasting and constant value based upon a change in the geometry of the lifting and articulate arms.

3. The device according to claim 1, wherein the compensation device is hydraulic.

4. The device according to claim 1, wherein the compensation device has at least one pressure limitation valve.

5. The device according to claim 1, wherein the compensation device has at least one directional valve.

6. The device according to claim 5, wherein the at least one directional valve is a 2/2-way valve.

7. The device according to claim 5, wherein the at least one directional valve is electrically switchable.

8. The device according to claim 1, wherein the vehicle crane has a cable winch, the compensation device being formed at least partly on the cable winch.

9. The device according to claim 8, wherein the compensation device cooperates with the cable winch.

10. The device according to claim 8, wherein the cable winch has a drive, the compensation device cooperating with the drive of the cable winch.

11. The device according to claim 1, wherein the compensation device has a distance sensor, the distance sensor being detachably fastenable on an end of the load cable.

12. The device according to claim 11, wherein the distance sensor has at least one spring element.

13. The device according to claim 12, wherein the at least one spring element is a gas spring.

14. The device according to claim 1, wherein the vehicle crane is an articulated arm crane.

15. A method for keeping a tension of a load cable of a vehicle crane constant, the load cable being guided on a lifting arm and an articulated arm which can be varied with respect to one another in relation to their geometry, said method comprising:

tensioning the load cable by means of a cable winch in cooperation with a compensation device;

winding the load cable onto the cable winch by the compensation device based upon a change in the geometry of the lifting and articulated arms with respect to one another which causes a shortening of the guidance of the load cable on the lifting and articulate arms; and unwinding the load cable from the cable winch by the compensation device based upon a further change in the geometry of the lifting and articulate arms with respect to one another which causes a lengthening of the guidance of the load cable on the lifting and articulate arms.

16. The method according to claim 15, wherein the vehicle crane is an articulated arm crane.

* * * * *